United States Patent [19]

Csokasy et al.

[11] 4,034,438

[45] July 12, 1977

[54] CLOSURE COUNTER-BALANCE

[75] Inventors: Louis R. Csokasy, Bristol, Ind.; Neil E. Robb, Jackson, Mich.

[73] Assignee: Excel Industries, Incorporated, Elkhart, Ind.

[21] Appl. No.: 623,369

[22] Filed: Oct. 17, 1975

[51] Int. Cl.[2] ..... E05F 5/06

[52] U.S. Cl. ..... 16/85; 403/166; 403/104

[58] Field of Search ..... 16/49, 66, 85, 82; 403/104, 109, 166

[56] References Cited

U.S. PATENT DOCUMENTS

| | | | |
|---|---|---|---|
| 3,380,097 | 4/1968 | Pharris | 403/301 X |
| 3,711,892 | 1/1973 | Tabor | 16/85 |

FOREIGN PATENT DOCUMENTS

| | | | |
|---|---|---|---|
| 1,297,408 | 6/1969 | Germany | 287/DIG. 8 |

*Primary Examiner*—Wayne L. Shedd

*Attorney, Agent, or Firm*—Whittemore, Hulbert & Belknap

[57] ABSTRACT

The closure counter-balance is for attachment as a strut between a hingedly mounted movable closure and a support structure. The counter-balance includes a pair of tubular members telescopingly connected together in sliding relationship. A compression coil spring within the members urges the members apart. Means are provided to frictionally lock the tubular members together in any given relative position thereof. Means are also provided to pivotally attach one end of the counter-balance to the support structure, said means including a release mechanism for easy disengagement thereof. The other end of the counter-balance is provided with latch means which cooperate with means on the support structure to lock the counter-balance in the closed position.

4 Claims, 6 Drawing Figures

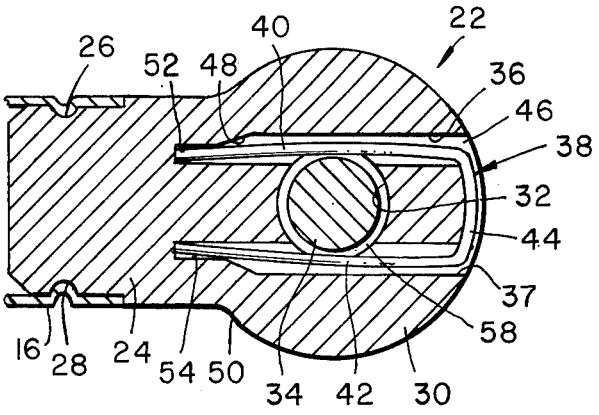
FIG. 3
FIG. 4
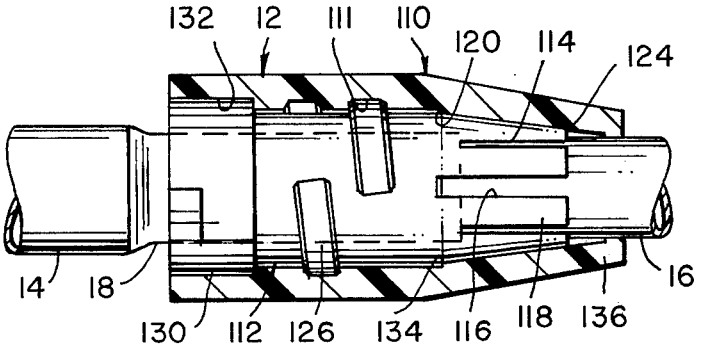
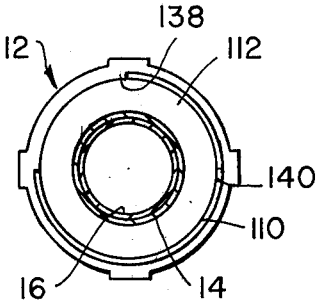
FIG. 5
FIG. 6
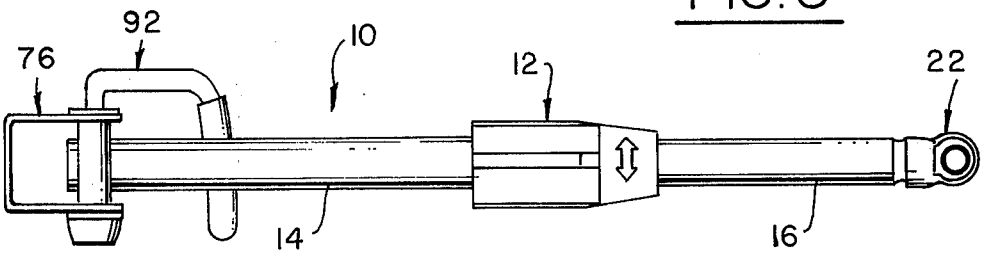

CLOSURE COUNTER-BALANCE

BACKGROUND OF THE INVENTION

This invention is in the field of counter-balancing devices. In many instances, it is desirable to counter-balance the weight of a movable closure and to hold the closure safely in an open position. Such closures may be, for example, large windows on farm tractors, automobile deck lids and hatch covers, hoods and tailgates. These closures are desirably counter-balanced in an open position. The general type of closure counter-balance contemplated by the present invention is, for example, described in U.S. Pat. Nos. 3,711,892 and 3,797,817.

The present invention constitutes an improvement over such prior art structures in that means are provided to frictionally lock the counter-balance; in any given position thereby preventing bouncing of the movable closure in the event that the vehicle upon which it is mounted is driven. Additionally, the present invention provides means for release of the counter-balance from fixed structure to which one end is attached and also means are provided for latching the counter-balance in the closed position to prevent opening of the movable closure.

SUMMARY OF THE INVENTION

A counter-balance for a movable closure on a structure is provided. The counter-balance comprises an outer tubular member and an inner tubular member. The tubular members are telescopingly connected together in sliding relationship. Each of said tubular members has abutment structure at the outer end thereof. A compression coil spring is provided within said member. The end of said spring presses against the abutment structure thereby urging the tubular members apart. The outer tubular member has a locking mechanism on the inner end thereof. The locking mechanism includes structure to frictionally engage the inner tubular member to frictionally lock said member together. Means are also provided to pivotally attach one end of the counter-balance to the support structure. These means include a release mechanism for easy disengagement from the support structure. The other end of the counter-balance is provided with latch means which cooperates with means on the support structure to lock the counter-balance in the closed position.

IN THE DRAWINGS

FIG. 3 is a sectional view taken substantially along the line 3—3 of FIG. 1 looking in the direction of the arrows;

FIG. 4 is a view of the locking mechanism for the closure counter-balance with the outer locking member in section for the purpose of clarity;

FIG. 5 is a sectional view taken substantially along the line 5—5 of FIG. 1 looking in the direction of the arrows; and FIG. 6 is a top plan view of the closure counter-balance on a reduced scale with respect to FIG. 2 to illustrate the entire length of the closure counter-balance.

The closure counter-balance 10 is adapted to be mounted, for example, on a vehicle between a hinged closure member and fixed support structure of the vehicle. For instance, the closure counter-balance 10 might be mounted in a farm tractor of the type having an enclosed cab for the tractor operator. Such cabs are provided with large windows which are hingedly fastened to the cab structure. The closure counter-balance 10 is adapted to permit movement of such windows from fully closed positions to fully opened positions as desired by the operator. The closure counter-balance 10 is provided with spring structure sufficiently strong to maintain such windows in the fully opened position.

However, when such a tractor is driven, the windows will bounce if the only means of support thereof is a spring structure. Therefore, a locking mechanism 12 has been provided for the closure counter-balance 10 to permit locking of the closure counter-balance in the open position thereby preventing such bouncing. The locking mechanism 12 provides for infinite adjustment of the window from the fully opened to fully closed positions. Further, means have been provided for latching the closure counter-balance 10 in the closed position to prevent unwanted opening of a window by the spring structure or from the outside by unauthorized personnel. Additionally, mechanism for release of the closure counter-balance 10 from fixed structure of the vehicle is provided to facilitate disengagement of the closure counter-balance from the vehicle when desired.

It should be appreciated that while the closure counter-balance 10 has been described above as being used in connection with a window of a farm tractor, the closure counter-balance 10 may be utilized in any situation where it is desired to provide such a counter-balance device for opening and closing of a hinged panel structure.

Figure 1:
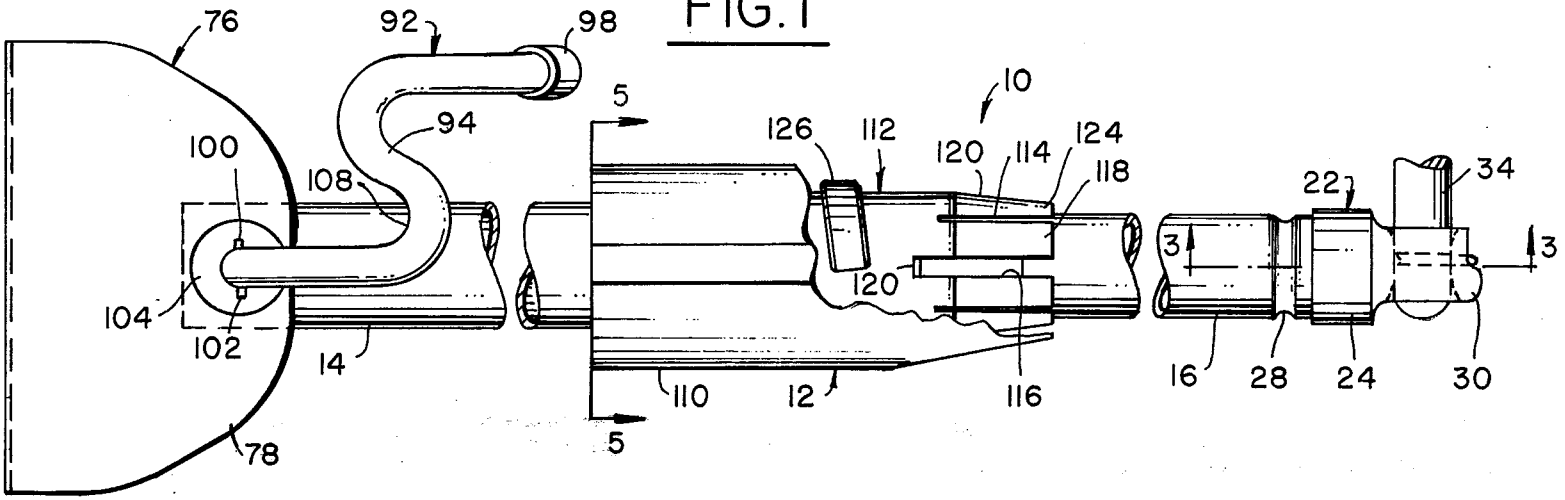
FIG. 1 is a side elevational view of one embodiment of the closure counter-balance in accordance with the present invention.
Figure 2:
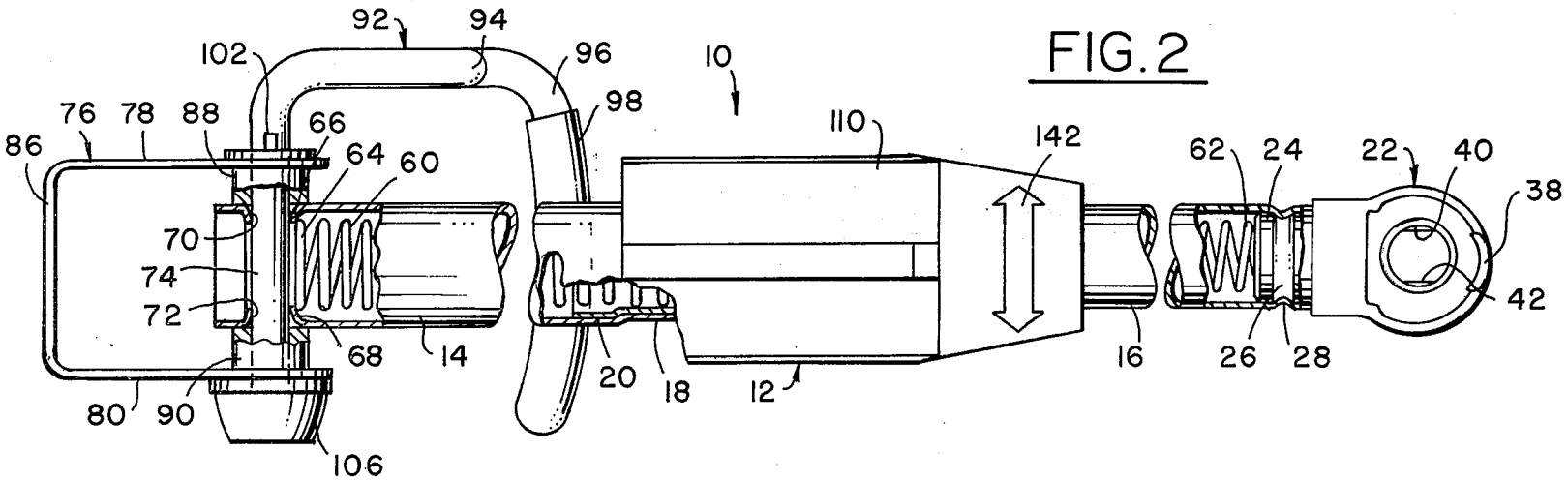
FIG. 2 is a top plan view of the closure counter-balance of FIG. 1.

As shown in FIGS. 1, 2 and 6, the closure counter-balance 10 comprises a pair of telescopic tubular members 14, 16. The tubular member 14 is of larger diameter than the member 16 so that these members may be telescoped together. The diameter of member 14 is sufficiently greater than the diameter of member 16 to provide for a space therebetween. The provision of such a space provides the necessary clearance for the members to telescope into and out of each other.

The inner end 18 of the tubular member 14 is rolled radially inwardly to define a bearing area for sliding contact with the tubular member 16. Similarly, the inner end 20 of the tubular member 16 is rolled radially outwardly to define a bearing area for sliding contact with the tubular member 14 (FIG. 2). The rolled ends 18, 20 also provide stop means as shown in FIG. 2 to prevent the tubular members 14, 16 from disengaging each other. The ends 18, 20 thus limit the extent of extension of the closure counter-balance.

An integral bracket and closure element 22 is provided on the outer end of the tubular member 16. The element 22 may be fabricated of, for example, metal, plastic or a reinforced plastic such as glass filled nylon. The element 22 has a plug or closure portion 24 which is received within the outer end of the tubular member 16. An annular groove 26 is provided in portion 24. An annular portion 28 of the member 16 is crimped into the groove 26 to secure the parts together.

The element 22 has a portion 30 which extends out from the closure portion 28. The portion 30 has an opening 32 therethrough for the reception of a pin 34 which is secured to fixed structure of a vehicle. The portion 30 permits swiveling of the closure counter-balance 10 about the pin 34 during extension and retraction of the closure counter-balance.

A disconnect structure is also provided in conjunction with the element 22 to permit disengagement of the closure counter-balance 10 from the pin 34, as will be noted in FIGS. 2 and 3. A pair of longitudinally extending passages 36, 37 are provided in the portion 30 of element 22. A retainer 38 fabricated of spring wire is received in the passages 36, 37. The retainer 38 has a pair of spaced apart legs 40, 42 each of which are received in a passage 36, 37. The legs 40, 42 are joined by portion 44 which is positioned exteriorally of the element 22 on ledge 46. The passages 36, 37 gradually narrow at 48, 50 and terminate in narrow portions 52, 54. When the retainer 38 is forced all the way into the passages 36, 37 as illustrated in FIG. 3, the leg portions 46, 48 are flexed towards each other to engage the groove 58 of the pin 34, thus preventing separation of the counter-balance from the pin. The counter-balance may be disengaged from the pin 34 simply by removal of retainer 38.

An elongated compression coil spring 60 is provided within the tubular members 14, 16. One end 62 of the spring 60 abuts against the inner face of the plugged portion 24 of the element 22. The other end 64 abuts against inturned portions 66, 68 of the tubular member 14. The inturned portions 66, 68 are formed as a consequence of extruding openings 70, 72 in the end portion of tubular member 14 to receive a pin 74 which pivotally mounts the outer end of the tublar member 14. The function of the spring 60 is essentially to counter-balance the weight of the hinged panel, such as a tractor window, to which the closure counter-balance is attached. Upon unlatching of the window, the window needs manual assistance to pivot a short distance, generally about 10 degrees. The spring 60 will then lift the window manually unassisted.

The closure counter-balance 10 is secured to the hinged panel by means of a U-shaped bracket 76 which has opening means in the legs 78, 80 for reception of the pin 74. Openings are provided in bracket wall 86 for the reception of both for securing of the bracket to structure of the panel to which the closure counter-balance is attached. Grommets 88, 90 of rubber or other material are provided on the pin 74 within the bracket 76 to maintain the tubular member 14 spaced from the legs 78, 80 of the bracket.

The pin 74 forms part of a latch element 92. The latch element 92 has an S-shaped central portion 94 from which the pin 74 and lever portion 96 extend at right angles in the same direction. A sleeve 98 is provided on lever portion 96 to facilitate manual grasping of the lever portion. Ears 100, 102 are formed in the pin 74 at a point in which the pin merges with the S-shaped portion 94. The ears 100, 102 limit the distance which the pin may be inserted into the bracket 76. A washer 104 is provided between the ears 100, 102 and the surface of the bracket leg 78. The other end of the pin 74 extends through the other leg 80. A plastic cap 106 having a metal insert to grip pin 74 is received snugly on the ends of the pin to hold the latch 92 in place on the bracket.

The latch 92 is pivotable from the non-engaging position shown in FIGS. 1 and 2 to a position engaging fixed structure of the vehicle. The latch 92 is pivoted counter-clockwise as viewed in FIG. 1 whereupon the curved portion 108 will engage latching structure mounted on the vehicle to latch the window or other structure connected to the closure counter-balance in a closed position. The latch 92 not only prevents opening of the panel structure by means of the spring 60 but also prevents unwanted opening of such panel structure from the vehicle exterior.

As previously stated, a locking mechanism 12 is provided to lock the closure counter-balance in the fully open or any intermediate position. The locking mechanism 12 may, of course, also be used to lock the closure counter-balance in the closed position although the latch 92 also will essentially accomplish this function.

The locking mechanism 12 includes an outer hollow cylindrical member 110 and an inner hollow cylindrical member 112. The inner member 112 is slip fitted onto the end 18 of tubular member 14. The member 112, which may be fabricated of a plastic material such as an acetal homopolymer, extends beyond the inner end of the tubular member 14. The portion which extends beyond member 14 is slotted with alternate narrow slots 114 and wide slots 116 to thereby define a plurality of fingers 118 which are capable of being deflected into frictional engagement with the tubular member 16 to thereby frictionally lock tubular members 14, 16 in any given relative position. Tab portions 120 are bent upwardly from the material of the inner end of the tubular member 14 to secure the inner member 112 in place. The fingers 118 are tapered from the base 120 to the outer tip 124 to permit a wedging action with the outer member 110.

A screw thread 126 is provided exteriorally at the approximate center of the inner member 112. There may be less than or more than one thread. The outer member 110 has an internal groove 111 which engages the thread 126. The outer member 110 is received on inner member 112. The inner member 112 has an enlarged portion 130 which is received in a recess 132 of member 110. This relationship functions to guide the member 110 onto the member 112 and also to limit the extent to which member 110 may be threaded onto member 112.

The forward interior surface of the outer member 110 has a taper which extends from point 134 radially inwardly to point 136. This taper is at a slightly different angle than the taper of the finger 118 in order to improve the lock up capabilities of the units. When the outer member 110 is threaded onto the inner member 112, the interiorally tapered portion of the outer member 110 wedges against the fingers 118 causing the fingers to deflect into frictional contact with the tubular member 16 thus resulting in the frictional engagement heretofore referred to. This results in the tubular members being frictionally locked together. The tubular members may be released from such frictional engagement by unthreading of the outer member 110.

Separation of these members is prevented by structure shown in FIG. 5. As it will be therein noted, a radially inwardly extending projection 138 is provided on the interior surface of the outer member 110. A radially outwardly extending projection 140 is provided on the inner member 112. Upon unthreading of the members, projection 140 will contact projection 138 thereby preventing complete unthreading of the parts. An arrow 142 is provided on the outer member 110 to indicate that the locking mechanism is actuated by twisting of the outer member 110.

Having thus described our invention, we claim:

1. A counter-balance for a movable closure on a structure comprising an outer tubular member and an inner tubular member, said tubular members being telescopingly connected together in sliding relationship, each of said tubular members having abutment structure at the outer end thereof, a compression coil spring within said members, the ends of said spring pressing against said abutment structures thereby urging said tubular members apart, said outer tubular member having a locking mechanism on the inner end thereof, said locking mechanism including structure to frictionally engage the inner tubular members to frictionally lock said members together, said locking mechanism including an inner hollow cylindrical element and an outer hollow cylindrical element, said inner hollow cylindrical element being secured on the inner end of said tubular member, a portion of said inner hollow cylindrical element extending beyond the inner end of said outer tubular member over the inner tubular member, said extending portion comprising a plurality of circumferentially spaced apart fingers, said outer hollow cylindrical element being received on said inner hollow cylindrical element, said outer hollow cylindrical element having an interior surface portion tapered radially inwardly, said tapered portion terminating in a section which has a diameter less than the outer diameter defined by said fingers whereby passage of said outer hollow cylindrical element onto said inner hollow cylindrical element eventually results in deflection of said fingers into frictional engagement with said inner tubular member as a consequence of contact of the fingers with said tapered interior surface portion of the outer hollow cylindrical element, said fingers being tapered radially inwardly from the outer surface of the bases thereof to the tips thereof at a slightly different angle than the taper of the tapered interior surface of the outer hollow cylindrical element to thereby result in a wedging action therewith.

2. A counter-balance as defined in claim 1, further characterized in the provision of a screw thread portion on the outer surface of the inner hollow cylindrical element, said outer hollow cylindrical element having an interior screw thread groove portion receiving said screw thread whereby said outer hollow cylindrical element may be threaded onto or off of the inner hollow cylindrical element to cause engagement or release of said fingers with said inner tubular member, and cooperative locking means on the inner and outer hollow cylindrical elements to prevent disengagement of said elements as a consequence of unthreading of the outer hollow cylindrical element.

3. A counter-balance as defined in claim 1, further characterized in the provision of bracket means extending outwardly from each outer end of each tubular member, said bracket means being provided for pivotally connecting one end of the counter-balance to a movable closure and pivotally connecting the other end of the counter-balance to said structure which said movable closure is on, said bracket means on said other end of the closure comprising a portion having a central opening for the reception of a pin having an annular groove thereon, said portion including means for release of said pin comprising a pair of spaced apart passages extending longitudinally from the outer end of said portion, a pair of spaced apart wire elements received in said passages, the inner end portions of said passages being narrower than the previous portions to flex the wire elements towards each other to be received in the groove of said pin and lock the pin in place.

4. A counter-balance as defined in claim 1, further characterized in the provision of bracket means extending outwardly from each outer end of each tubular member, said bracket means being provided for pivotally connecting one end of the counter-balance to a movable closure and pivotally connecting the outer end of the counter-balance to said structure which said movable closure is on, the abutment structure at said one end of the counter-balance comprising a pin structure, said one end of the counter-balance having opening means therein through which said pin extends with portions thereof extending exteriorally of said opening means, a bracket on said one end of the closure counter-balance pivotally secured to the outwardly extending portions of said pin structure, said pin structure forming part of a latch element, said latch element including an S-shaped central portion, said pin structure extending at substantially right angles from one end of said S-shaped portion, a manually engageable lever extending from the other end of said S-shaped portion, said latch element being pivotable to a position wherein said S-shaped portion is engageable with cooperative latching means secured to the structure on which said movable enclosure is on when said movable closure is closed to thereby prevent extension of said counter-balance to open said movable closure.

* * * * *